US011325800B2

(12) United States Patent
Tatematsu et al.

(10) Patent No.: US 11,325,800 B2
(45) Date of Patent: May 10, 2022

(54) IMAGE FORMING APPARATUS

(71) Applicant: BROTHER KOGYO KABUSHIKI KAISHA, Nagoya (JP)

(72) Inventors: Hirotaka Tatematsu, Nagoya (JP); Tetsuya Morita, Nagoya (JP); Koyo Yamamoto, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 130 days.

(21) Appl. No.: 16/727,768

(22) Filed: Dec. 26, 2019

(65) Prior Publication Data

US 2020/0207566 A1 Jul. 2, 2020

(30) Foreign Application Priority Data

Dec. 28, 2018 (JP) ..... JP2018-246388

(51) Int. Cl.

| | |
|---|---|
| ***B65H 7/02*** | (2006.01) |
| ***G03G 21/18*** | (2006.01) |
| ***B65H 9/06*** | (2006.01) |
| ***B65H 9/12*** | (2006.01) |
| ***B65H 9/14*** | (2006.01) |

(52) U.S. Cl.

CPC ..... *B65H 9/06* (2013.01); *B65H 9/12* (2013.01); *B65H 9/14* (2013.01); *G03G 21/1892* (2013.01); *B65H 2553/612* (2013.01); *G03G 2221/1684* (2013.01); *G03G 2221/1892* (2013.01)

(58) Field of Classification Search

CPC ..... B65H 2553/612; B65H 2553/61; B65H 9/06; B65H 9/12; B65H 9/14; G03G 2221/1684; G03G 2221/1892; G03G 21/1892

See application file for complete search history.

(56) References Cited

U.S. PATENT DOCUMENTS 6,885,831 B2 * 4/2005 Lee ..... G03G 21/1896 399/111
7,242,874 B2 * 7/2007 Tsusaka ..... G03G 15/6529 399/111

FOREIGN PATENT DOCUMENTS

JP 2010-100349 A 5/2010
JP 2010-235256 A 10/2010
JP 2011051698 A * 3/2011

* cited by examiner

*Primary Examiner* — Luis A Gonzalez
(74) *Attorney, Agent, or Firm* — Baker Botts L.L.P.

(57) ABSTRACT

An image forming apparatus includes a casing, an image forming unit movable between an accommodated position and a shifted position, an actuator, an urging member, a cam, and a contact portion. The actuator includes a pivot shaft and a protrusion protruding therefrom. The protrusion at a standby position crosses a conveyance path and is contactable with a sheet conveyed along the conveyance path. When the image forming unit is at the accommodated position, the contact portion and the cam contact each other and maintain the protrusion at the standby position against an urging force of the urging member. As the image forming unit moves from the accommodated position to the shifted position, the contact portion and the cam move away from each other such that the protrusion pivots from the standby position, by the urging force, to a retracted position at which the protrusion is retracted from the conveyance path.

15 Claims, 12 Drawing Sheets

IMAGE FORMING APPARATUS

CROSS-REFERENCE TO RELATED APPLICATION

This application claims priority from Japanese Patent Application No. 2018-246388 filed on Dec. 28, 2018, the content of which is incorporated herein by reference in its entirety.

TECHNICAL FIELD

Aspects described herein relate to an image forming apparatus.

BACKGROUND

A known image forming apparatus includes photosensitive drums, process cartridges, and a drawer unit supporting the drums and the cartridges. The drawer unit is movable horizontally to an exterior of an apparatus casing for cartridge replacement.

The image forming apparatus further includes a spring and a gate actuator for detecting the passing of a sheet that are disposed between a sheet cassette and the drawer unit. The gate actuator is swingable and is urged by the spring toward an upstream side in a conveyance direction. The leading edge of a sheet hits the gate actuator and thus the gate actuator swings so that the passing of the sheet is detected.

SUMMARY

In the above image forming apparatus, however, when the drawer unit moves from an interior of the casing toward an exterior of the casing, the photosensitive drums may interfere or collide with the gate actuator and result in damage to the gate actuator, depending on the positional relationship between the gate actuator and the drawer unit.

The drawer unit is one of image forming units movable to an exterior of the apparatus casing. The movable image forming units includes a single photosensitive member, a process unit having a single developing cartridge, a belt unit to face photosensitive drums, and a fixing unit that applies heat and pressure to a sheet having an image. Similarly, when such an image forming unit moves from an interior of a casing toward an exterior of the casing, the image forming unit may interfere or collide with an actuator for detecting the passing of a sheet and result in damage to the actuator.

Aspects of the disclosure provide an image forming apparatus configured to prevent damage to a protrusion of an actuator during movement of an image forming unit between an accommodated position and a shifted position.

According to one or more aspects of the disclosure, an image forming apparatus includes a casing, an image forming unit, an actuator, an urging member, a cam, and a contact portion. The image forming unit is movable between an accommodated position at which the image forming unit is accommodated in the casing and faces a conveyance path along which a sheet is conveyed in a conveyance direction, and a shifted position which is located upstream from the accommodated position in the conveyance direction and at which the image forming unit is shifted toward an exterior of the casing. The actuator is pivotally supported by one of the casing and the image forming unit. The actuator includes a pivot shaft and a protrusion. The pivot shaft extends in a direction orthogonal to the conveyance direction. The protrusion protrudes from the pivot shaft. The protrusion at a standby position crosses the conveyance path and is contactable with a sheet conveyed along the conveyance path. The urging member exerts an urging force to urge the protrusion upstream in the conveyance direction. The cam is movable with movement of the pivot shaft at a position away from the protrusion in a direction in which the pivot shaft extends. The contact portion is located at the other of the casing and the image forming unit. The contact portion and the cam are configured to, when the image forming unit is at the accommodated position, contact each other and maintain the protrusion at the standby position against the urging force of the urging member. The contact portion and the cam are configured to, as the image forming unit moves from the accommodated position to the shifted position, move away from each other such that the protrusion pivots from the standby position, by the urging force of the urging member, upstream in the conveyance direction to a retracted position at which the protrusion is retracted from the conveyance path.

The image forming apparatus thus may prevent an occurrence of damage to the protrusion of the actuator during movement of the image forming unit between the accommodated position and the shifted position.

DETAILED DESCRIPTION

Illustrative embodiments of the disclosure will be described with reference to the accompany drawings.

First Embodiment

Figure 1:
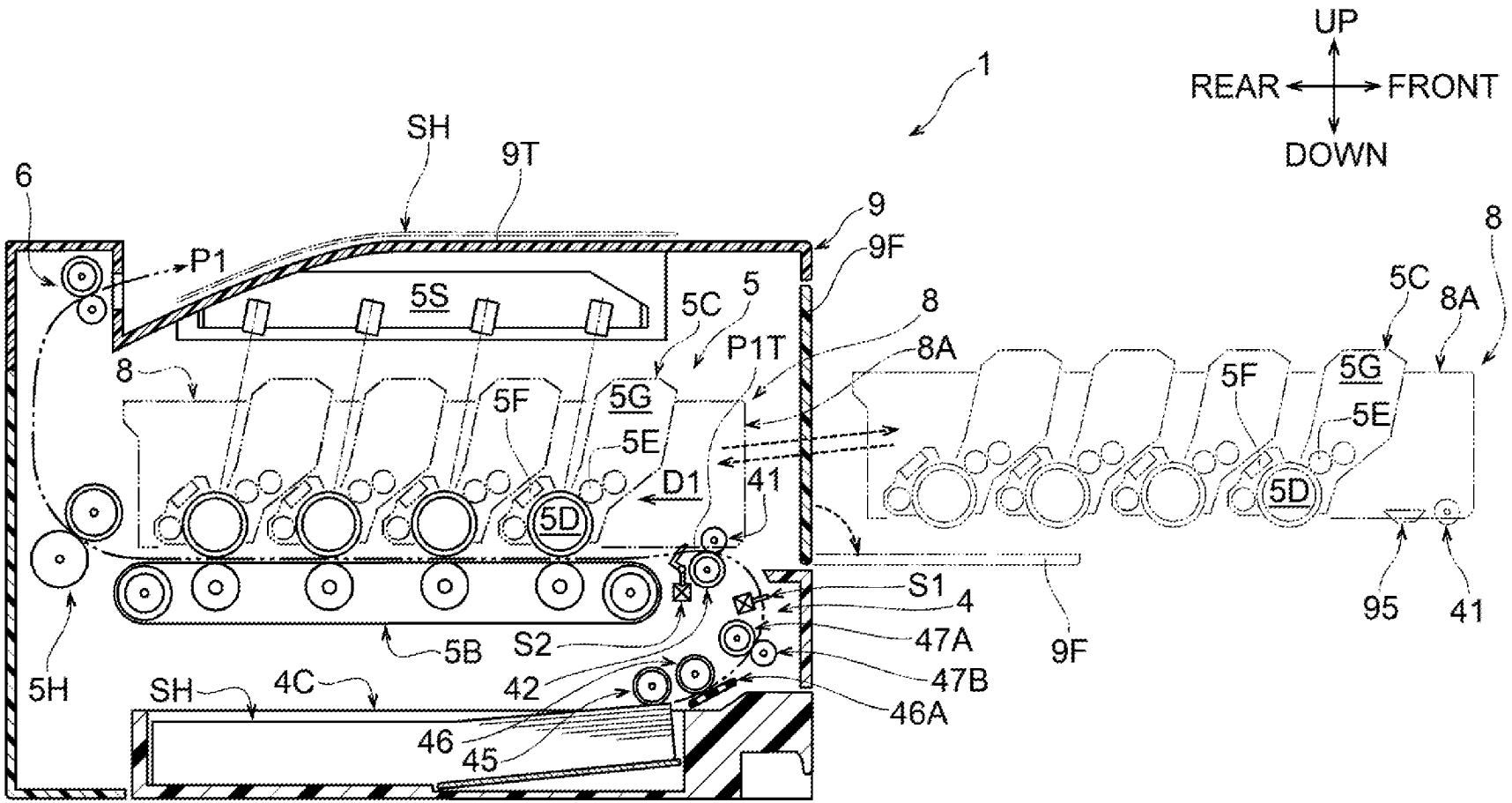
FIG. 1 is a schematic cross sectional view of an image forming apparatus according to a first illustrative embodiment of the disclosure.

FIG. 1 shows an image forming apparatus 1 according to aspects of the disclosure. The image forming apparatus 1 is a laser printer for electrophotographically forming an image on a sheet.

Figure 2:
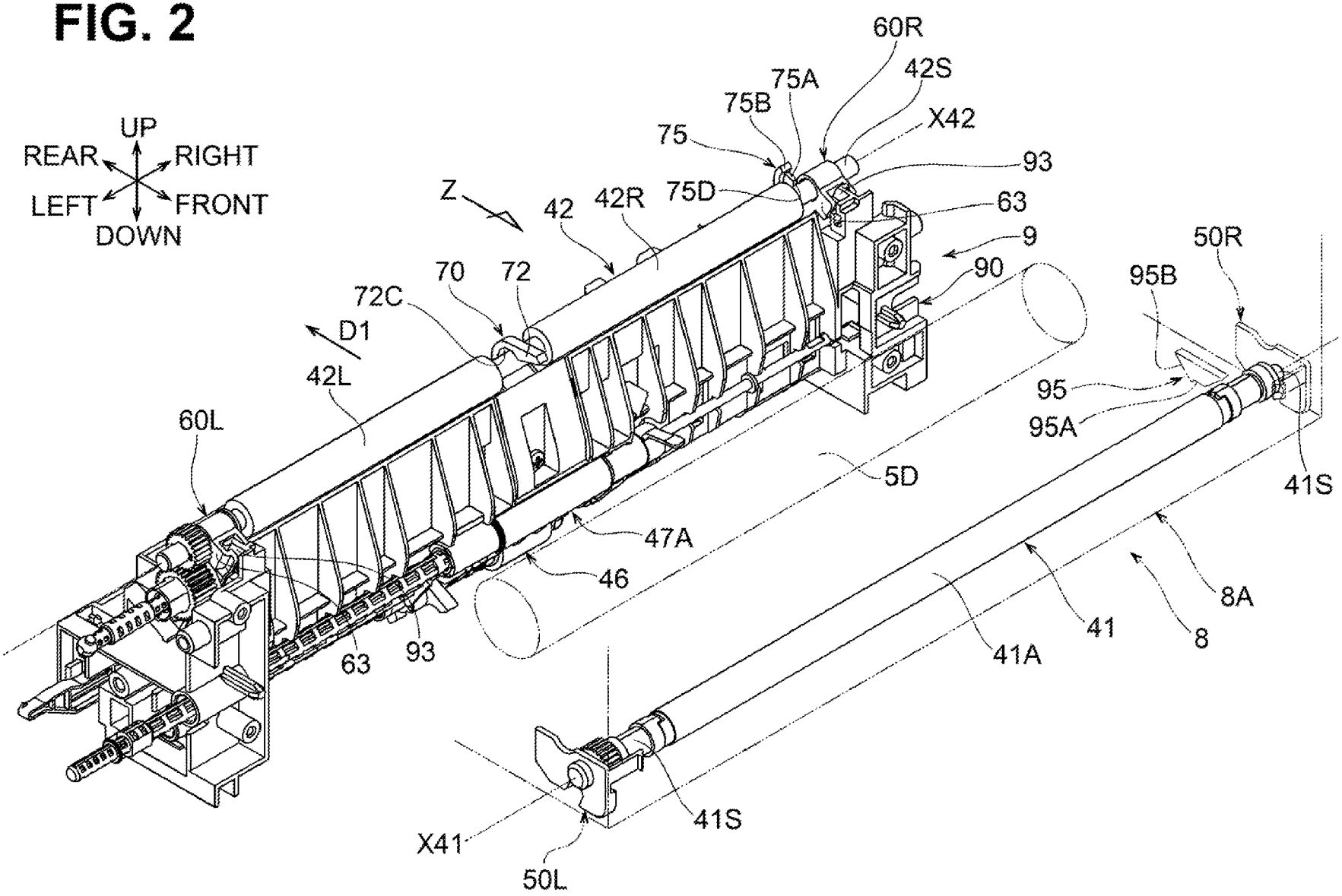
FIG. 2 is a partial perspective view illustrating a photosensitive drum, a first roller, and a contact portion, which are disposed at a drawer unit, and a second roller, an actuator, and a cam, which are disposed at a casing according to the image forming apparatus of the first illustrative embodiment of the disclosure.
Figure 3:
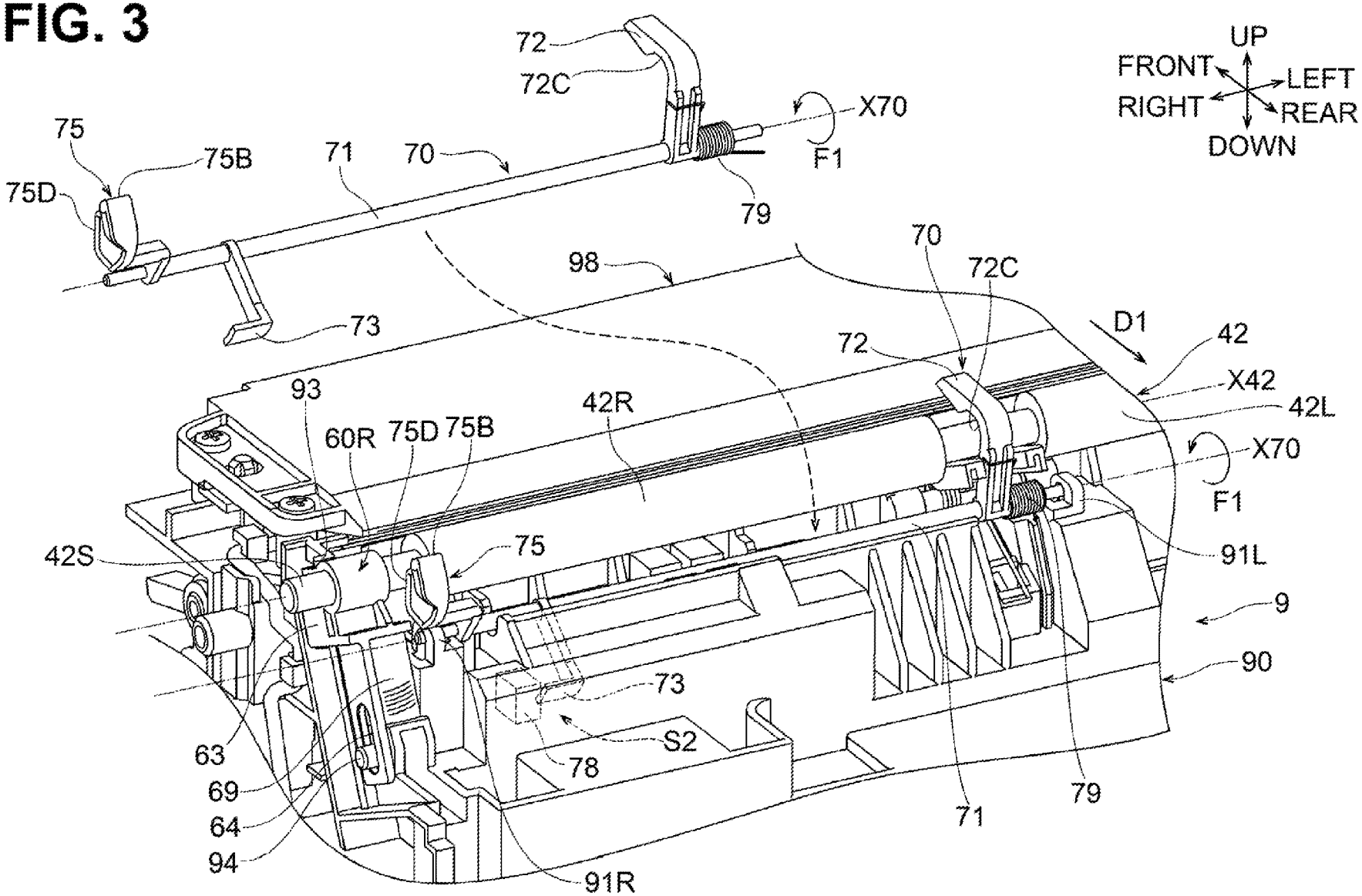
FIG. 3 is an enlarged perspective view illustrating the second roller, the actuator, the cam, and other elements, when viewed in an arrowed direction Z of FIG. 2.

A front-rear direction and an up-down direction are illustrated in FIG. 1 by defining right and upper sides of the page of FIG. 1 as front and upper sides of the image forming apparatus 1, respectively. A front-rear direction and an up-down direction shown in FIG. 2 and subsequent drawings correspond to the directions shown in FIG. 1. A left-right direction is illustrated in FIGS. 2 and 3 by defining a side facing out of the page of FIG. 1 as a left side of the apparatus. Elements of an image forming apparatus 1 will now be described with reference to FIG. 1 and other drawings.

Overall Structure of Image Forming Apparatus

As illustrated in FIG. 1, the image forming apparatus 1 includes a casing 9, a sheet tray 4C, a feeder 4, an image forming unit 5, and a discharge unit 6.

The image forming apparatus 1 includes, in the casing 9, inner frames. The inner frames include a first frame 90 illustrated in FIGS. 2 and 3 and a second frame 98 illustrated in FIG. 3. The second frame 98 is an example of a frame.

As illustrated in FIG. 1, the sheet tray 4C is disposed at a lower portion of the casing 9. The sheet tray 4C holds a stack of sheets SH. The casing 9 includes a discharge tray 9T in its upper portion. The discharge tray 9T receives a sheet SH having an image formed thereon.

The casing 9 defines a conveyance path P1. The conveyance path P1 has a substantially S shape. The conveyance path P1 extends from a front end portion of the sheet tray 4C upward to curve in a U shape, extends rearward substantially horizontally, and then extends, at the rear of the casing 9, upward to the discharge tray 9T to curve in a U shape.

A conveyance direction to convey a sheet SH varies along the conveyance path P1 shaped like the letter S. In the drawings, a conveyance direction in a substantially horizontal portion of the conveyance path P1 is illustrated as a conveyance direction D1. The conveyance direction D1 is a rearward direction. The front surface of the casing 9 is on an upstream side in the conveyance direction D1. The rear surface of the casing 9 is on a downstream side in the conveyance direction D1.

The feeder 4 includes, along the U-shaped curved portion of the conveyance path P1, a feed roller 45, a separation roller 46, a separation piece 46A, a conveying roller 47A, a pinch roller 47B, a first sensor S1, a first roller 41, a second roller 42, and a second sensor S2. The U-shaped curved portion extends from the front end portion of the sheet tray 4C.

The pinch roller 47B is pressed against the conveying roller 47A. The first sensor S1 is disposed between the rollers 47A, 47B and the rollers 41, 42 in the conveyance path P1.

The first roller 41 and the second roller 42, which will be described in detail later, are disposed at an upper end NT of the U-shaped curved portion which is an upstream portion of the conveyance path P1 in the conveyance direction D1. The second roller 42 is disposed facing the first roller 41 from below and is pressed against the first roller 41.

The second sensor S2, which will be described in detail later, is disposed at a position near the upper end PIT of the conveyance path P1 and downstream from the first roller 41 and the second roller 42 in the conveyance direction D1. The second sensor S2 detects the passing of a sheet SH conveyed by the first roller 41 and the second roller 42 and transmits the passing to a controller not illustrated.

The controller causes the feeder 4 to feed from the sheet tray 4C one sheet SH at a time, fed by the feed roller 45 and separated by the separation roller 46 and the separation piece 46A, toward the conveying roller 47A and the pinch roller 47B.

Subsequently, in the feeder 4, the conveying roller 47A and the pinch roller 47B pinch and convey the sheet SH therebetween toward the first roller 41 and the second roller 42. At that time, the controller stops the first roller 41 and the second roller 42 until a predetermined time has elapsed after detection by the first sensor S1 of a leading edge of the sheet SH conveyed by the conveying roller 47A and the pinch roller 47B. Thereafter, the controller starts rotating the first roller 41 and the second roller 4. The first roller 41 and the second roller 42, against which the leading edge of the sheet SH is abutted, corrects or reduces skewing of the sheet SH. The first roller 41 and the second roller 42 then pinch and convey the sheet SH toward the image forming unit 5. The controller controls the image forming unit 5 based on a timing of the second sensor S2 detecting the leading edge of the sheet SH conveyed by the first roller 41 and the second roller 42.

In other words, the first roller 41 and the second roller 42 are registration rollers which register the sheet SH by temporarily stopping the leading edge of the sheet SH conveyed toward the first roller 41 and the second roller 42 and then start rotating to convey the sheet SH toward the image forming unit 5.

The image forming unit 5 is disposed above the sheet tray 4C in the casing 9. The sheet SH fed by the feeder 4 passes through the image forming unit 5 along a substantially horizontal portion of the conveyance path P1.

The image forming unit 5 is of a direct tandem type capable of color printing. The image forming unit 5 includes a drawer unit 8, a transfer belt 5B, a scanner 5S, and a fixing unit 5H. The drawer unit 8 is an example of an image forming unit.

The drawer unit 8 is a single unit including a drawer 8A, photosensitive drums 5D, and toner cartridges 5C. The photosensitive drums 5D are each an example of a photosensitive member.

The drawer 8A has a known structure and thus is schematically illustrated in the drawings. The drawer 8A is a frame-shaped structure in which side walls and connecting members are assembled. The side walls are disposed on the sides into and out of the page of FIG. 1 and extend in the front-rear direction. The connecting members extend in the left-right direction to connect the side walls.

Four photosensitive drums 5D, which correspond to black, yellow, magenta, and cyan toners, are rotatably supported by the drawer 8A in tandem along the substantially horizontal portion of the conveyance path P1.

Four toner cartridges 5C, which correspond to black, yellow, magenta, and cyan toners, are detachably held by the drawer 8A in tandem along the substantially horizontal portion of the conveyance path P1. Each toner cartridge 5C includes a developing roller 5E, a charger 5F and a toner chamber 5G, which are disposed around a corresponding photosensitive drum 5D.

When a front cover 9F is pivoted to a position indicated by two-dot chain lines in FIG. 1 to be open at the front of the casing 9, the drawer unit 8 is movable in the front-rear direction between an accommodated position and a shifted position.

The drawer unit 8, when at the accommodated position, is accommodated in the casing 9 and faces, from above, the substantially horizontal portion of the conveyance path P1 for conveying a sheet SH.

The shifted position of the drawer unit 8 is located upstream from the accommodated position in the conveyance direction D1. The drawer unit 8, when at the shifted position, is shifted toward an exterior of the casing 9 or frontward.

In this embodiment, the drawer unit 8, when at the shifted position, is removed from the casing 9 and the entire drawer unit 8 is outside of the casing 9. When the drawer unit 8 moves frontward from the accommodated position toward the shifted position, the drawer unit 8 traces a gently oblique upward path. When the drawer unit 8 moves rearward from the shifted position toward the accommodated position, the drawer unit 8 traces the reverse path.

The drawer unit 8 at the shifted position allows for removal of a sheet SH jammed in the conveyance path P1 and maintenance such as replacement of a toner cartridge 5C.

The transfer belt 5B is disposed below the photosensitive drums 5D to define therebetween the substantially horizontal portion of the conveyance path P1. The transfer belt 5B circulates while pinching, in conjunction with each of the photosensitive drums 5D, a sheet SH being conveyed.

The scanner 5S includes laser emitters, a polygon mirror, lenses, and reflecting mirrors, which are known elements. The scanner 5S downwardly emits laser beams corresponding to black, yellow, magenta, and cyan toward the respective photosensitive drums 5D.

The fixing unit 5H includes a heat roller and a pressure roller. The heat roller and the pressure roller pinch therebetween a sheet SH that has passed under the toner cartridges 5C and apply heat and pressure to the sheet SH.

The image forming apparatus 5 thus structured forms an image on a sheet SH as described below. In each toner cartridge 5C, after a charger 5F uniformly and positively charge a surface of a rotating photosensitive drum 5D, the scanner 5S irradiates the surface of the photosensitive drum 5D. The irradiated surface of the photosensitive drum 5D carries an electrostatic latent image corresponding to an image to be formed on a sheet SH. Subsequently, a developing roller 5E supplies toner stored in a toner chamber 5G to the surface of the photosensitive drum 5D in accordance with the electrostatic latent image. The toner carried on the surface of the photosensitive drum 5D is transferred onto the sheet SH. The sheet SH having toners transferred from the photosensitive drums 5D thereon is subjected to heat and pressure at the fixing unit 5H, and thus toners are fixed onto the sheet SH.

The discharge unit 6 includes a discharge roller and a pinch roller disposed most downstream in the conveyance path P1. The discharge roller and the pinch roller pinch therebetween the sheet SH with the fixed toners and discharge the sheet SH to the discharge tray 9T.

Structure of First Roller

As illustrated in FIG. 2, the first roller 41 includes a first rotation shaft 41S and a cylindrical portion 41A. The first rotation shaft 41S extends in the left-right direction along a first axis X41. The cylindrical portion 41A extends in an axial direction of the first rotation shaft 41S and is fixed to the first rotation shaft 41S to be rotatable integrally with the first rotation shaft 41S.

The drawer 8A includes first holders 50L, 50R. A left first holder 50L is fixed to a lower front corner of the left side wall of the drawer 8A. A right first holder 50R is fixed to a lower front corner of the right side wall of the drawer 8A.

A left end of the first rotation shaft 41S is rotatably supported by the left first holder 50L. A right end of the first rotation shaft 41S is rotatably supported by the right first holder 50R.

The first roller 41 is thus supported by the drawer 8A via the first holders 50L, 50R such that the first roller 41 is rotatable about the first axis X41. As illustrated in FIGS. 1 and 2, as the drawer unit 8 moves toward the shifted position, the first roller 41 also moves toward an exterior of the casing 9.

Figure 4:
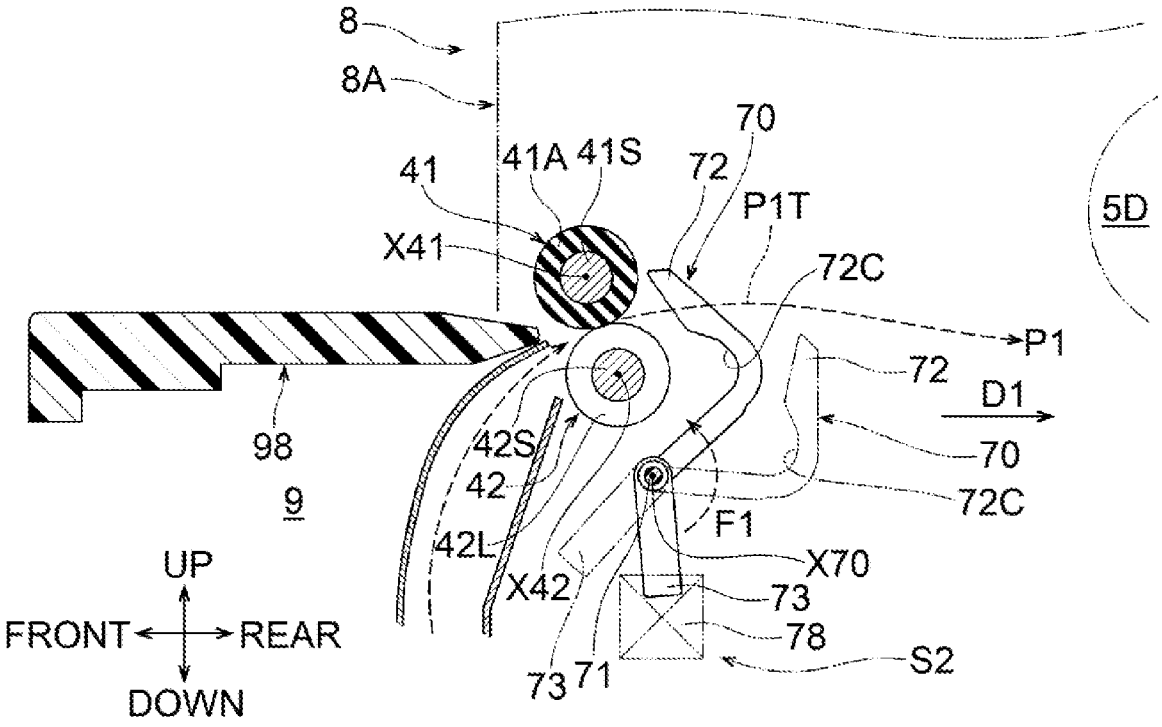
FIG. 4 is a schematic, partial cross sectional view illustrating a positional shift of the actuator when the drawer unit is at an accommodated position.
Figure 5:
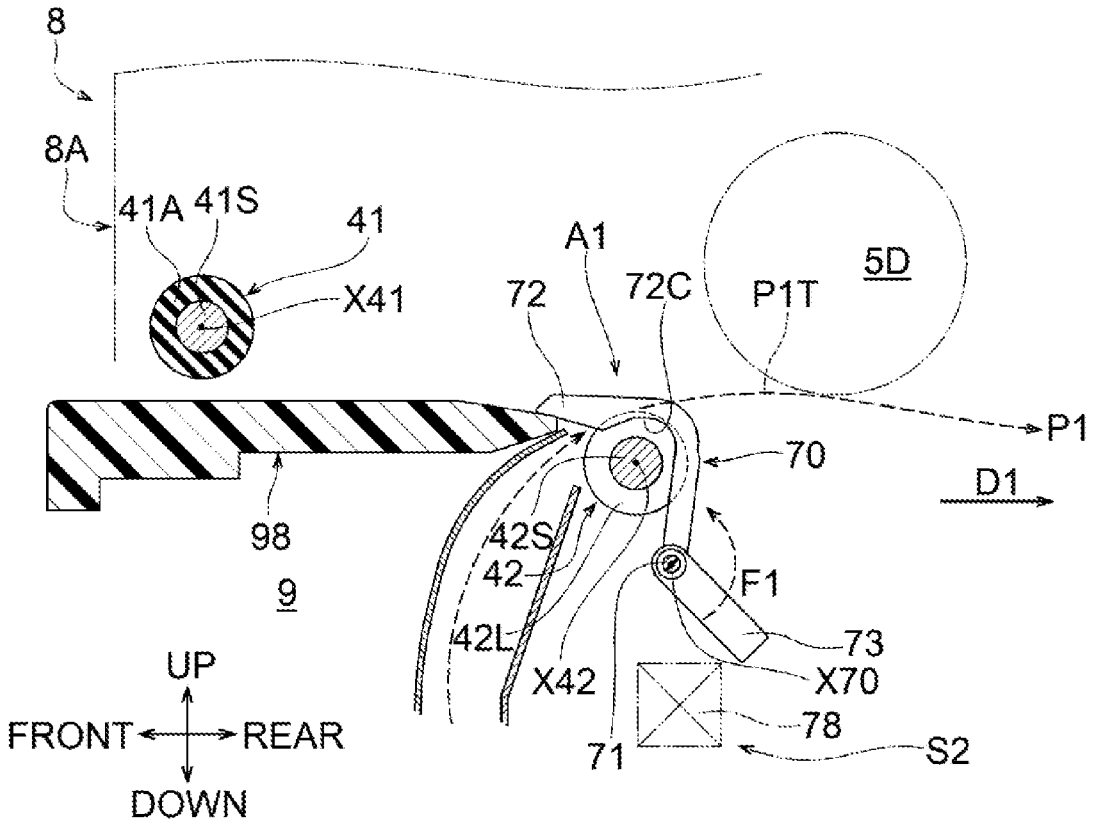
FIG. 5 is a schematic, partial cross sectional view illustrating a positional shift of the actuator when the drawer unit moves between the accommodated position and a shifted position.

As illustrated in FIG. 4, when the drawer unit 8 is at the accommodated position, the first roller 41 is located at a position where the first roller 41 and the second roller 42 can convey a sheet SH. As illustrated in FIG. 5, when the drawer unit 8 moves from the accommodated position toward the shifted position, the first roller 41 moves frontward from a position illustrated in FIG. 4. Thereafter, a space is left in the casing 9. The space left after the first roller 41 moves is regarded as a first space A1.

Structure of Second Roller

As illustrated in FIG. 2, the second roller 42 is rotatably supported by the first frame 90 as described below. The separation roller 46 and the conveying roller 47A of the feeder 4 are also rotatably supported by the first frame 90. Although omitted from the drawings, the feed roller 45 of the feeder 4 is also rotatably supported by the first frame 90.

As illustrated in FIGS. 3 and 4, the second frame 98 is a flat plate extending in the front-rear direction and the left-right direction, and assembled to an upper portion of the first frame 90 at a position in front of the second roller 42. The second frame 98 is disposed upstream from the second roller 42 in the conveyance direction D1.

As illustrated in FIGS. 2 and 3, the second roller 42 includes a second rotation shaft 42S, a first cylindrical portion 42L, and a second cylindrical portion 42R. The second rotation shaft 42S is an example of a rotation shaft of a second roller.

The second rotation shaft 42S extends in the left-right direction along a second axis X42. The first cylindrical portion 42L and the second cylindrical portion 42R extend in an axial direction of the second rotation shaft 42S and are fixed to the second rotation shaft 42S to be rotatable integrally with the second rotation shaft 42S. The first cylindrical portion 42L and the second cylindrical portion 42R are spaced by a particular distance apart from each other in the left-right direction.

As illustrated in FIG. 2, the casing 9 includes second holders 60L, 60R. A left second holder 60L is movably held at a left end of the first frame 90. A right second holder 60R is movably held at a right end of the first frame 90.

More specifically, as illustrated in FIG. 3, a guide portion 63, which is formed at the right end of the first frame 90, is inserted into the right second holder 60R. A shaft 94, which is formed at the right end of the first frame 90, is inserted into a slot 64 formed in the right second holder 60R. This enables the right second holder 60R to move linearly in the up-down direction and pivot about the shaft 94 such that an upper end of the right second holder 60R is movable in the front-rear direction.

A helical compression spring 69 is disposed between the right second holder 60R and the right end of the first frame 90. The right second holder 60R is urged upward and frontward by the helical compression spring 69.

Although simply illustrated, the left second holder 60L is similar in structure to the right second holder 60R. The left second holder 60L is movable linearly in the up-down direction, pivotable such that an upper end of the left second holder 60L moves in the front-rear direction, and urged upward and frontward.

As illustrated in FIG. 2, a left end of the second rotation shaft 42S is rotatably supported at the upper end of the left second holder 60L. Aright end of the second rotation shaft 42S is rotatably supported at an upper portion of the right second holder 60R.

The second roller 42 is thus supported by the casing 9 movably relative to the first roller 41, and is urged upward and frontward toward the first roller 41.

As illustrated in FIGS. 1 and 4, when the drawer unit 8 is at the accommodated position, the second roller 42 is located near and slightly to the rear of the first roller 41. Thus, the second roller 42 is unlikely to prevent the first roller 41 from moving frontward.

Structures of Second Sensor, Cam, and Contact Portion

As illustrated in FIG. 3, the second sensor S2 includes a photo interrupter 78, an actuator 70, and a helical torsion spring 79. The helical torsion spring 79 is an example of an urging member.

The image forming apparatus 1 includes a cam 75 and a contact portion 95. The cam 75 is integrally formed with the actuator 70. As illustrated in FIGS. 1 and 2, the contact portion 95 is located at the drawer 8A of the drawer unit 8. The contact portion 95 is configured to act on the cam 75 to change the position of the actuator 70.

As illustrated in FIG. 3, the photo interrupter 78 of the second sensor S2 is disposed in the first frame 90. The photo interrupter 78 transmits an ON or OFF signal corresponding to an open or block state of a light path, which is not illustrated, to the controller.

As illustrated in FIG. 4, when the drawer unit 8 is at the accommodated position, the actuator 70 is located upstream from the photosensitive drum 5D in the conveyance direction D1. Similarly, the cam 75 integrally formed with the actuator 70 is also located upstream from the photosensitive drum 5D in the conveyance direction D1.

As illustrated in FIG. 3, the actuator 70 includes a pivot shaft 71, a protrusion 72, and a detected portion 73, together with the cam 75. In this embodiment, the actuator 70 is a resin member integrally including the pivot shaft 71, the protrusion 72, the detected portion 73, and the cam 75.

The pivot shaft 71 extends along a pivot axis X70 extending in the left-right direction orthogonal to the conveyance direction D1.

The first frame 90 is formed with bearings 91L, 91R. The left bearing 91L is located in a position to the rear of and below a right end of the first cylindrical portion 42L of the second roller 42. The right bearing 91R is located in a position to the rear of and below a right end of the second cylindrical portion 42R of the second roller 42.

A left end of the pivot shaft 71 is pivotally supported by the left bearing 91L. A right end of the pivot shaft 71 is pivotally supported by the right bearing 91R. The pivot shaft 71 is thus pivotally supported by the casing 9 in a position to the rear of and below the second rotation shaft 42S of the second roller 42.

The protrusion 72 is integrally coupled to the left end of the pivot shaft 71. The protrusion 72 extends out from the pivot shaft 71 in a radial direction thereof orthogonal to the pivot axis X70. When viewed in the left-right direction, the protrusion 72 is substantially L-shaped and has a bend of which inner corner defining a recessed portion 72C.

The helical torsion spring 79 has a coiled portion located to the left end of the pivot shaft 71, one end engaged near the left bearing 91L of the first frame 90, and the other end engaged with the protrusion 72. The helical torsion spring 79 thus exerts an urging force F1 to urge the protrusion 72 upstream in the conveyance direction D1. In FIGS. 4 to 10, the urging force F1 is indicated instead of the helical torsion spring 79.

As illustrated in FIGS. 3 and 5, as the drawer unit 8 moves toward the shifted position, a distal end of the protrusion 72, which has pivoted frontward by the urging force F1, contacts and stops at the second frame 98. This restricts the pivoting of the actuator 70 and maintains the protrusion 72 at the position.

Figure 6:
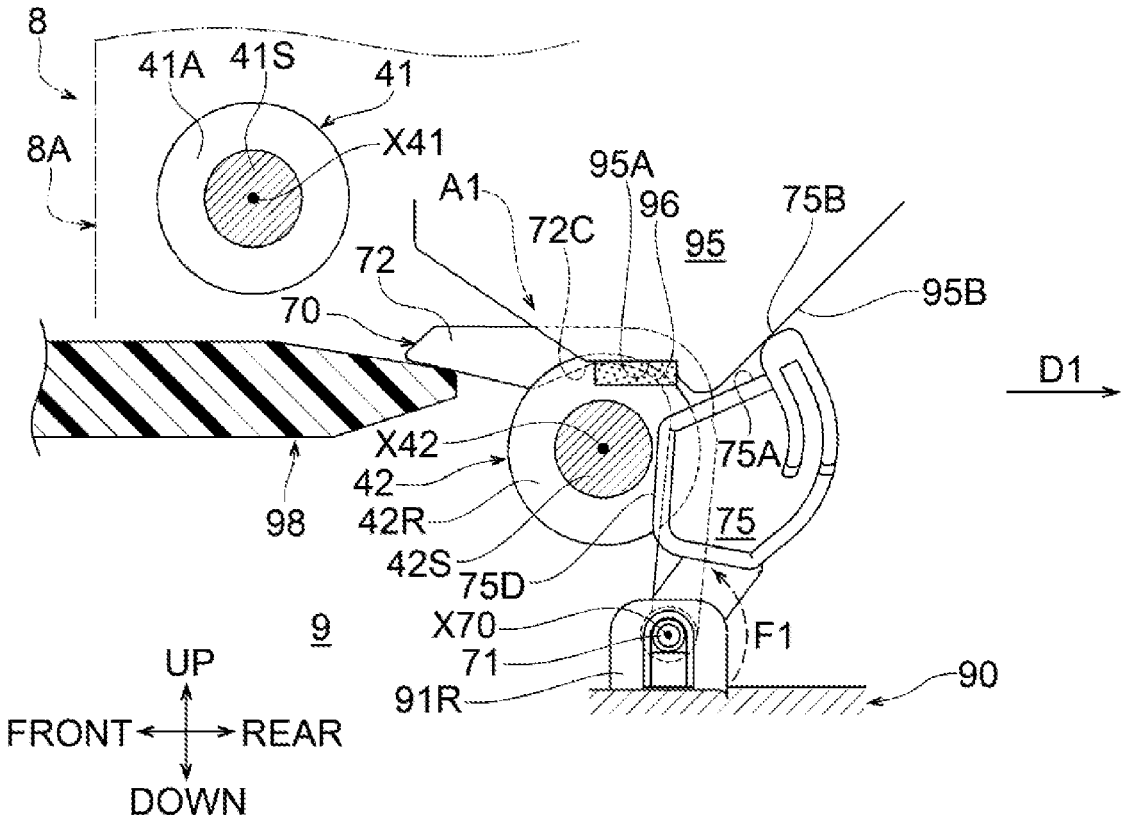
FIG. 6 is a schematic, partial cross sectional view illustrating positional shifts of the cam, the contact portion, and a protrusion when the drawer unit moves between the accommodated position and the shifted position.

FIGS. 2 and 3 illustrate that the protrusion 72 is at a retracted position. FIGS. 5 and 6 also illustrate that the protrusion 72 is at the retracted position.

As illustrated in FIGS. 2 and 3, when the protrusion 72 pivots to the retracted position, the protrusion 72 enters a gap between the right end of the first cylindrical portion 42L and the left end of the second cylindrical portion 42R. As illustrated in FIG. 5, when the protrusion 72 pivots to the retracted position, the protrusion 72 is retracted from the conveyance path P1 and enters the first space A1, which is left after the first roller 41 moves.

The protrusion 72 at the retracted position is shaped such that the protrusion 72 extends upward from the pivot shaft 71 to the conveyance path P1, and then bends upstream in the conveyance direction D1 to extend along the conveyance path P1.

When the protrusion 72 is at the retracted position, the recessed portion 72C is recessed upward to stay out of the second rotation shaft 42S and its upper portion downwardly faces the second rotation shaft 42S.

In the following description about shapes of the detected portion 73 and the cam 75, the up-down direction and the front-rear direction are based on the position of the actuator 70 when the protrusion 72 is at the retracted position.

As illustrated in FIG. 3, the detected portion 73 is integrally coupled to the pivot shaft 71 at a position away to the left from the right end of the pivot shaft 71. The detected portion 73 extends out from the pivot shaft 71 in a radial direction thereof orthogonal to the pivot axis X70. When the protrusion 72 is at the retracted position, the detected portion 73 protrudes downward and rearward in the first frame 90. As illustrated in FIG. 5, when the protrusion 72 is at the retracted position, a lower end of the detected portion 73 is located away rearward from the photo interrupter 78 and the light path of the photo interrupter 78 is open.

As illustrated in FIG. 3, the cam 75 is integrally coupled to the right end of the pivot shaft 71. The cam 75 bends from the pivot shaft 71 and extends out in a radial direction thereof orthogonal to the pivot axis X70.

The cam 75 is located at a position away to the right from the right end of the second cylindrical portion 42R of the second roller 42. As illustrated in FIG. 2, a right end of the photosensitive drum 5D is located at substantially the same position as the right end of the second cylindrical portion 42R in the left-right direction. The cam 75 is thus located closer to an exterior of the casing 9 than each photosensitive drum 5D in the left-right direction. The cam 75 is movable with the movement of the pivot shaft 71 at a position away from the protrusion 72 in the left-right direction.

The cam 75 has a restrictive surface 75D, a cam surface 75A, and a protruding portion 75B.

As illustrated in FIG. 6, the restrictive surface 75D is a flat surface. When the protrusion 72 is at the retracted position, that is, the distal end of the protrusion 72 contacts and stops at the second frame 98, the restrictive surface 75D faces frontward and extends in the up-down direction. In this state, the restrictive surface 75D faces the second rotation shaft 42S from the rear with a slight space therebetween. If the protrusion 72 at the retracted position is subjected to a downward force, the restrictive surface 75D may contact and stop at the second rotation shaft 42S, thereby withstanding the force.

The cam surface 75A is an inclined surface connected to the upper end of the restrictive surface 75D and inclined upward to the rear. The protruding portion 75B connects with a rear end of the cam surface 75A and protrudes upward. The protruding portion 75B has rounded corners.

As illustrated in FIG. 2, the contact portion 95 of the drawer unit 8 is located upstream from the photosensitive drum 5D and downstream from the first roller 41 in the conveyance direction D1. The contact portion 95 protrudes downward at the rear of the right first holder 50R in the lower front corner of the right side wall of the drawer 8A.

The contact portion 95 is located at a position away to the right from the right end of the cylindrical portion 41A of the first roller 41. As illustrated in FIG. 2, the right end of the photosensitive drum 5D is located at substantially the same position as the right end of the cylindrical portion 41A in the left-right direction. The contact portion 95 is thus located closer an exterior of the drawer unit 8 or the casing 9 than each photosensitive drum 5D in the left-right direction.

Figure 8:
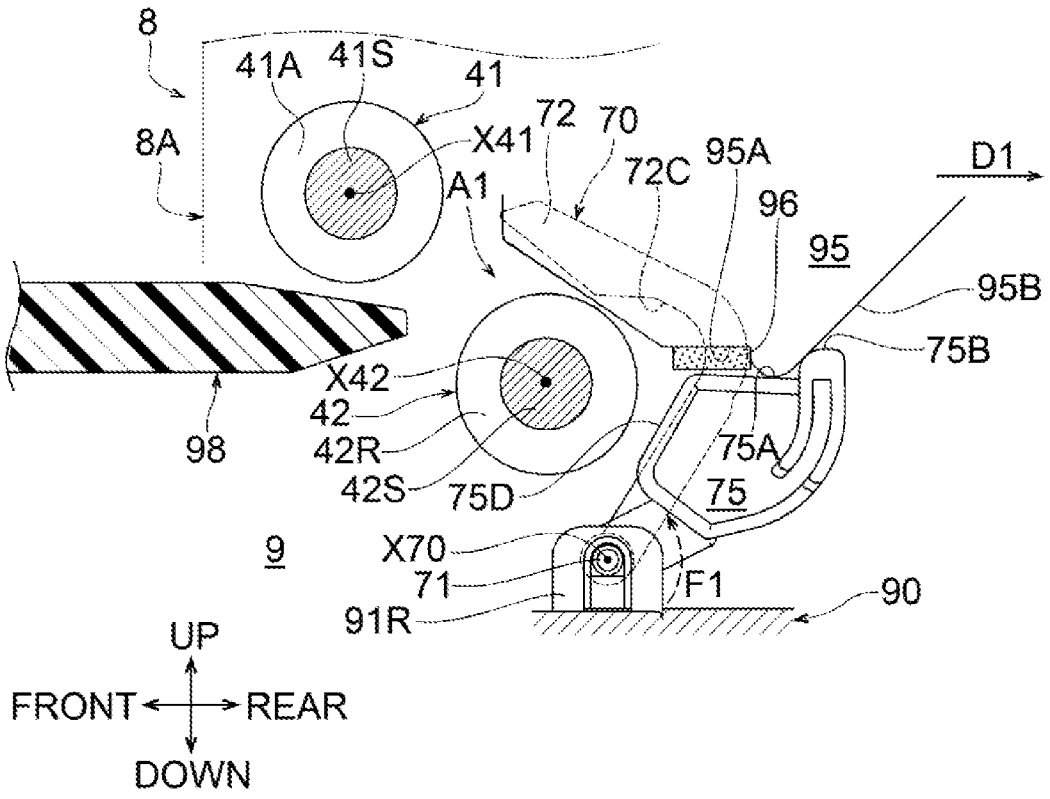
FIG. 8 is a schematic, partial cross sectional view illustrating positional shifts of the cam, the contact portion, and the protrusion when the drawer unit moves between the accommodated position and the shifted position.
Figure 9:
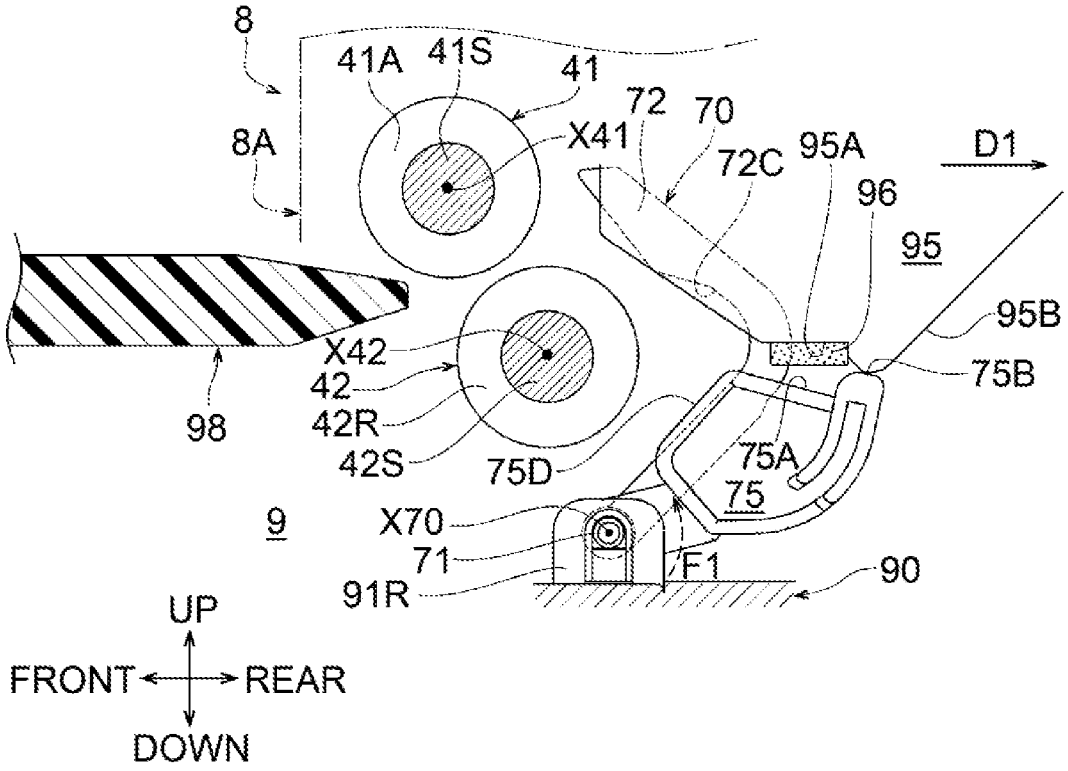
FIG. 9 is a schematic, partial cross sectional view illustrating positional shifts of the cam, the contact portion, and the protrusion when the drawer unit moves between the accommodated position and the shifted position.
Figure 10:
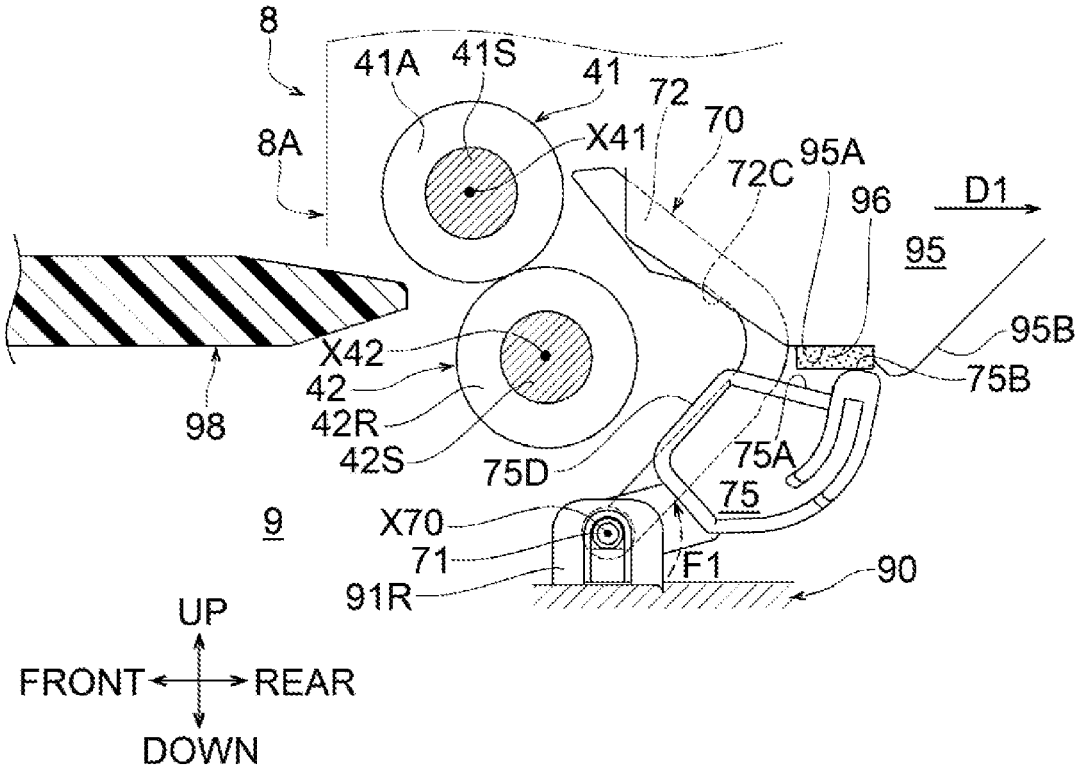
FIG. 10 is a schematic, partial cross sectional view illustrating positional shifts of the cam, the contact portion, and the protrusion when the drawer unit is at the accommodated position.

As illustrated in FIGS. 6 to 10, the contact portion 95 has a first surface 95A and a second surface 95B. FIG. 10 illustrates that the drawer unit 8 is at the accommodated position. In the order illustrated in FIGS. 9, 8, 7, and 6, a movement of the drawer unit 8 from the accommodated position toward the shifted position progressively increases.

As illustrated in FIG. 6, the first surface 95A faces downward and extends substantially horizontally in the front-rear direction. The first surface 95A is covered with a cushioning member 96. The cushioning member 96 may be appropriately selected from a foam, for example, a sponge, a polyurethane foam, and an EPDM foam; an elastomer; a gel; and other materials. The cushioning member 96 is affixed to the first surface 95A with a double-sided tape or adhesive.

The second surface 95B is an inclined surface connected to a rear end of the first surface 95A and inclined downward to the rear shortly and then upward to the rear. The second surface 95B has a rounded lower end.

Operation of Cam, Contact Portion, and Protrusion

As illustrated in FIG. 5, as the drawer unit 8 moves from the shifted position toward the accommodated position, each photosensitive drum 5D passes over the protrusion 72 at the retracted position, which extends along the conveyance path P1 with its distal end directed frontward, and moves downstream from the actuator 70 in the conveyance direction D1.

Although omitted from the drawings, at that time, the protrusion 72 is held at the retracted position by the urging force F1 as the contact portion 95 is located away to the front from the cam 75.

As illustrated in FIG. 6, as the drawer unit 8 moves further toward the accommodated position, the contact portion 95 approaches the cam 75 with the protrusion 72 remaining at the retracted position, and the first roller 41 approaches the second roller 42. Then, the second surface 95B of the contact portion 95 contacts the protruding portion 75B of the cam 75 ahead of the first surface 95A.

Figure 7:
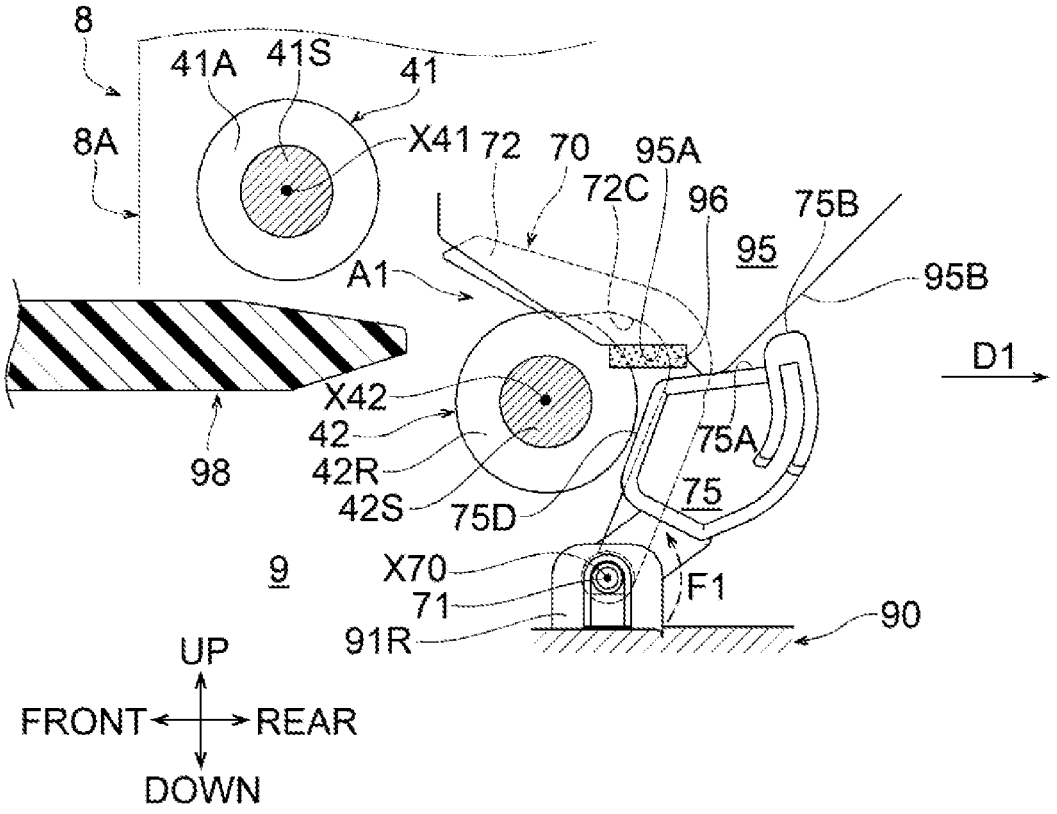
FIG. 7 is a schematic, partial cross sectional view illustrating positional shifts of the cam, the contact portion, and the protrusion when the drawer unit moves between the accommodated position and the shifted position.

As the drawer unit 8 moves further toward the accommodated position, the second surface 95B of the contact portion 95 presses the protruding portion 75B of the cam 75 downward against the urging force F1, and then, as illustrated in FIG. 7, the lower end of the second surface 95B of the contact portion 95 presses the cam surface 75A of the cam 75 downward against the urging force F1. The protrusion 72 thus starts pivoting downstream in the conveyance direction D1 ahead of the first roller 41 returning to the first space A1.

As illustrated in FIG. 8, as the drawer unit 8 moves further toward the accommodated position, the second surface 95B of the contact portion 95 presses the protruding portion 75B of the cam 75 downward, the lower end of the second surface 95B of the contact portion 95 presses the cam surface 75A of the cam 75 downward. Thereafter, as illustrated in FIG. 9, the lower end of the second surface 95B of the contact portion 95 presses the protruding portion 75B of the cam 75 downward. The protrusion 72 thus pivots further downstream in the conveyance direction D1.

As illustrated in FIG. 10, when the drawer unit 8 arrives at the accommodated position, the first roller 41 returns to the first space A1 and contacts the second roller 42. In this state, the first surface 95A of the contact portion 95 faces the protruding portion 75B of the cam 75 from above. The first surface 95A of the contact portion 95 thus maintains the protrusion 72 at a position illustrated in FIG. 10 against the urging force F1.

FIG. 10 illustrates that the protrusion 72 is at a standby position. FIG. 4 illustrates the standby position of the protrusion 72 with solid lines.

As indicated by the solid lines in FIG. 4, the protrusion 72 at the standby position extends upward from the pivot shaft 71, crosses the conveyance path P1, and is spaced downstream from the first roller 41 and the second roller 42 in the conveyance direction D1 by a particular distance.

The protrusion 72 at the standby position is contactable with a sheet SH conveyed along the conveyance path P1. As indicated by the solid lines in FIG. 4, when the protrusion 72 is at the standby position, the lower end of the detected portion 73 blocks the light path of the photo interrupter 78.

When a sheet SH conveyed along the conveyance path P1 contacts the protrusion 72, the sheet SH presses the protrusion 72 downstream in the conveyance direction D1 and then the protrusion 72 pivots to a position indicated by the two-dot chain lines in FIG. 4.

The position of the protrusion 72 indicated by the two-dot chain lines in FIG. 4 is a detection position. The protrusion 72 at the detection position allows the passing of the sheet SH conveyed along the conveyance path P1. As indicated by the two-dot chain lines in FIG. 4, as the protrusion 72 pivots to the detection position, the lower end of the detected portion 73 moves away from the photo interrupter 78 frontward and the light path of the photo interrupter 78 is opened.

When the sheet SH conveyed along the conveyance path P1 passes over the protrusion 72 at the detection position, the urging force F1 acts on the protrusion 72 to immediately return from the detection position to the standby position. At that time, as illustrated in FIG. 10, the protruding portion 75B of the cam 75, which pivots with the protrusion 72, contacts the cushioning member 96 affixed to the first surface 95A of the contact portion 95, and the cushioning member 96 may absorb an impact noise resulting from the contact.

A description will be briefly made about the operation where the drawer unit 8 moves from the accommodated position toward the shifted position, which is reverse to the above-described operation where the drawer unit 8 moves from the shifted position toward the accommodated position.

As the drawer unit 8 moves from the accommodated position toward the shifted position, the contact portion 95 located in front of the photosensitive drums 5D moves frontward from a position illustrated in FIG. 10. During this period, a positional relationship sequentially changes between the contact portion 95 and the cam 75 in the order illustrated in FIGS. 9, 8, 7, and 6. Specifically, the first surface 95A of the contact portion 95 faces the protruding portion 75B of the cam 75 and then the second surface 95B of the contact portion 95 contacts the protruding portion 75B or the cam surface 75A of the cam 75. The protrusion 72 thus pivots toward the retracted position by the urging force F1.

As illustrated in FIG. 5, as the photosensitive drum 5D moves frontward and approaches the protrusion 72, the contact portion 95 moves frontward away from the cam 75 and the protrusion 72 is maintained at the retracted position by the urging force F1. Each photosensitive drum 5D thus passes over the protrusion 72 at the retracted position, which extends along the conveyance path P1 with its distal end directed frontward, and moves upstream from the actuator 70 in the conveyance direction D1.

Effects

According to the image forming apparatus 1 of the first embodiment, as the drawer unit 8 moves upstream in the conveyance direction D1 from the accommodated position toward the shifted position, the cam 75, the contact portion 95, and the protrusion 72 act in the order illustrated in FIGS. 10, 9, 8, 7, and 6. At that time, to avoid the photosensitive drums 5D that come after the first roller 41, the protrusion 72 pivots from the standby position to the retracted position upstream in the conveyance direction D1 and is maintained at the retracted position. This structure prevents the photosensitive drums 5D and the first roller 41 in the drawer unit 8 that moves upstream in the conveyance direction D1 from interfering or colliding with the protrusion 72.

According to the image forming apparatus 1, as the drawer unit 8 moves downstream in the conveyance direction D1 from the shifted position toward the accommodated position, the cam 75, the contact portion 95, and the protrusion 72 act in the order illustrated in FIGS. 6, 7, 8, 9, and 10. At that time, to avoid the first roller 41 that comes after the photosensitive drums 5D, the protrusion 72 pivots from the retracted position to the standby position downstream in the conveyance direction D1 and is maintained at the standby position. This structure may prevent the photosensitive drums 5D and the first roller 41 in the drawer unit 8 that moves downstream in the conveyance direction D1 from interfering or colliding with the protrusion 72.

According to the image forming apparatus 1, when the drawer unit 8 is at the accommodated position and a sheet SH conveyed along the conveyance path P1 contacts the protrusion 72 at the standby position, the protrusion 72 pivots to the detection position indicated by the two-dot chain lines in FIG. 4 and thus the second sensor S2 detects the passing of the sheet SH.

The image forming apparatus 1 of the first embodiment thus may prevent interference of the drawer unit 8 with the protrusion 72 of the actuator 70 during movement of the drawer unit 8 between the accommodated position and the shifted position. This may prevent an occurrence of damage to the protrusion 72 of the actuator 70.

According to the image forming apparatus 1, as illustrated in FIG. 4, when the drawer unit 8 is at the accommodated position, the actuator 70 is located upstream from the photosensitive drum 5D in the conveyance direction D1. As illustrated in FIG. 2, the cam 75 and the contact portion 95 are located closer to an exterior of the casing 9 than each photosensitive drum 5D in the left-right direction. This may prevent the protrusion 72 and the cam 75 from contacting each photosensitive drums 5D while the drawer unit 8 moves between the accommodated position and the shifted position. This may prevent an occurrence of damage to each photosensitive drum 5D by contact with the protrusion 72 and the cam 75 and resulting degradation in quality of image to be formed on a sheet SH.

According to the image forming apparatus 1, as illustrated in FIG. 10, when the drawer unit 8 is at the accommodated position, the cam 75 and the contact portion 95 are located upstream from each photosensitive drum 5D in the conveyance direction D1. Although omitted from the drawings, the casing 9 includes a power supply unit for supplying power to the photosensitive drums 5D and a transmission mechanism to transmit a driving force to the photosensitive drums 5D. According to the above structure, the cam 75 and the contact portion 95 are disposed in a space not occupied by the power supply unit and the transmission mechanism. This may reduce the need to increase the physical size of the image forming apparatus 1.

According to the image forming apparatus 1, as illustrated in FIG. 3, the cam 75 is formed in one piece with the pivot shaft 71, that is, the cam 75 is a portion of the actuator 70. This reduces the number of parts required, thus resulting in reduced manufacturing cost.

As illustrated in FIG. 2, the image forming apparatus 1 includes the first roller 41 and the contact portion 95 that are disposed at the drawer 8A of the drawer unit 8. As illustrated in FIG. 2, the second roller 42, the actuator 70, the helical torsion spring 79, and the cam 75 are disposed at the first frame 90 of the casing 9. As illustrated in FIG. 5, as the first roller 41 moves with the drawer unit 8 moving from the accommodated position toward the shifted position, the protrusion 72 enters the first space A1, which is left after the first roller 41 moves. If the first roller 41 and the second roller 42 are disposed in the casing 9, the drawer unit 8 moving between the accommodated position and the shifted position may interfere with the first roller 41. In this embodiment, however, the first roller 41 is movable with the drawer unit 8. This may prevent the drawer unit 8 from interfering with the first roller 41. The protrusion 72, which pivots to the retracted position, enters the first space A1. This eliminates the need for extra space for moving the actuator 70 in the casing 9 into which the drawer unit 8 is inserted, and reduces the need to increase the physical size of the image forming apparatus 1.

According to the image forming apparatus 1, as illustrated in FIG. 5, the protrusion 72 at the retracted position is shaped such that the protrusion 72 extends from the pivot shaft 71 to the conveyance path P1, and then bends upstream in the conveyance direction D1 to extend along the conveyance path P1. When the drawer unit 8 moves between the accommodated position and the shifted position, the drawer unit 8 is less likely to interfere with the protrusion 72 at the retracted position. This eliminates the need to increase the size of a space in the casing 9 for accommodating the drawer unit 8, and reduces the need to increase the physical size of the image forming apparatus 1.

According to the image forming apparatus 1, as illustrated in FIGS. 2 and 3, when the protrusion 72 pivots to the retracted position, the protrusion 72 enters the gap between the right end of the first cylindrical portion 42L and the left end of the second cylindrical portion 42R. When the drawer unit 8 moves between the accommodated position and the shifted position, the drawer unit 8 is less likely to interfere with the protrusion 72 located in the gap between the first cylindrical portion 42L and the second cylindrical portion 42R. This eliminates the need to increase the size of a space in the casing 9 for accommodating the drawer unit 8, and reduces the need to increase the physical size of the image forming apparatus 1.

According to the image forming apparatus 1, as illustrated in FIG. 5, when the protrusion 72 is at the retracted position, the recessed portion 72C is recessed to stay out of the second rotation shaft 42S. This may reduce a height difference between the protrusion 72 at the retracted position and the second roller 42. When the drawer unit 8 moves between the accommodated position and the shifted position, the drawer unit 8 is less likely to interfere with the protrusion 72. This eliminates the need to increase the size of a space in the casing 9 for accommodating the drawer unit 8, and reduces the need to increase the physical size of the image forming apparatus 1.

According to the image forming apparatus 1, as illustrated in FIG. 5, the distal end of the protrusion 72, which receives the urging force F1, contacts and stops at the second frame 98, thereby maintaining the protrusion 72 at the retracted position. This structure may reduce a load applied to the protrusion 72, when compared with a structure where a portion of the protrusion 72 near the pivot shaft 71 contacts and stops at the second frame 98.

According to the image forming apparatus 1, as illustrated in FIG. 6, when the protrusion 72 is at the retracted position or the distal end of the protrusion 72 contacts and stops at the second frame 98, the restrictive surface 75D of the cam 75 faces the second rotation shaft 42S from the rear. If the protrusion 72 at the retracted position is subjected to a downward force, the restrictive surface 75D may contact and stop at the second rotation shaft 42S, thereby withstanding the force. Consequently, the protrusion 72 is less likely to sustain damage.

According to the image forming apparatus 1, as illustrated in FIGS. 6 to 10, when the drawer unit 8 moves between the accommodated position and the shifted position, the first surface 95A or second surface 95B of the contact portion 95 contacts the cam surface 75A or the protruding portion 75B of the cam 75, thereby smoothly moving the cam 75 integrally with the pivot shaft 71 and the protrusion 72, which are connected to the cam 75.

According to the image forming apparatus 1, as illustrated in FIG. 10, the cushioning member 96 is affixed to the first surface 95A of the contact portion 95. The cushioning member 96 may prevent the protruding portion 75B of the cam 75, which pivots with the protrusion 72 returning from the detection position to the standby position, from contacting the first surface 95A of the contact portion 95, and absorb an impact noise generated when the protruding portion 75B of the cam 75 contacts the cushioning member 96.

According to the image forming apparatus 1, as illustrated in FIGS. 6 to 10, when the drawer unit 8 moves from the shifted position toward the accommodated position, the second surface 95B of the contact portion 95 contacts the cam surface 75A or the protruding portion 75B of the cam 75. The protrusion 72 thus pivots downstream in the conveyance direction D1 ahead of the first roller 41 returning to the first space A1. Then, the first surface 95A of the contact portion 95 faces the protruding portion 75B of the cam 75, the cushioning member 96 on the first surface 95A contacts the protruding portion 75B, and the protrusion 72 is maintained at the standby position away from the first roller 41 and the second roller 42 downstream in the conveyance direction D1 by a particular distance. In other words, when the drawer unit 8 moves from the shifted position toward the accommodated position, the protrusion 72 pivots to the standby portion to avoid the first roller 41 returning to the first space A1. This may prevent the first roller 41 from interfering with the protrusion 72. Thus, the protrusion 72 is less likely to sustain damage.

Second Embodiment

Figure 11:
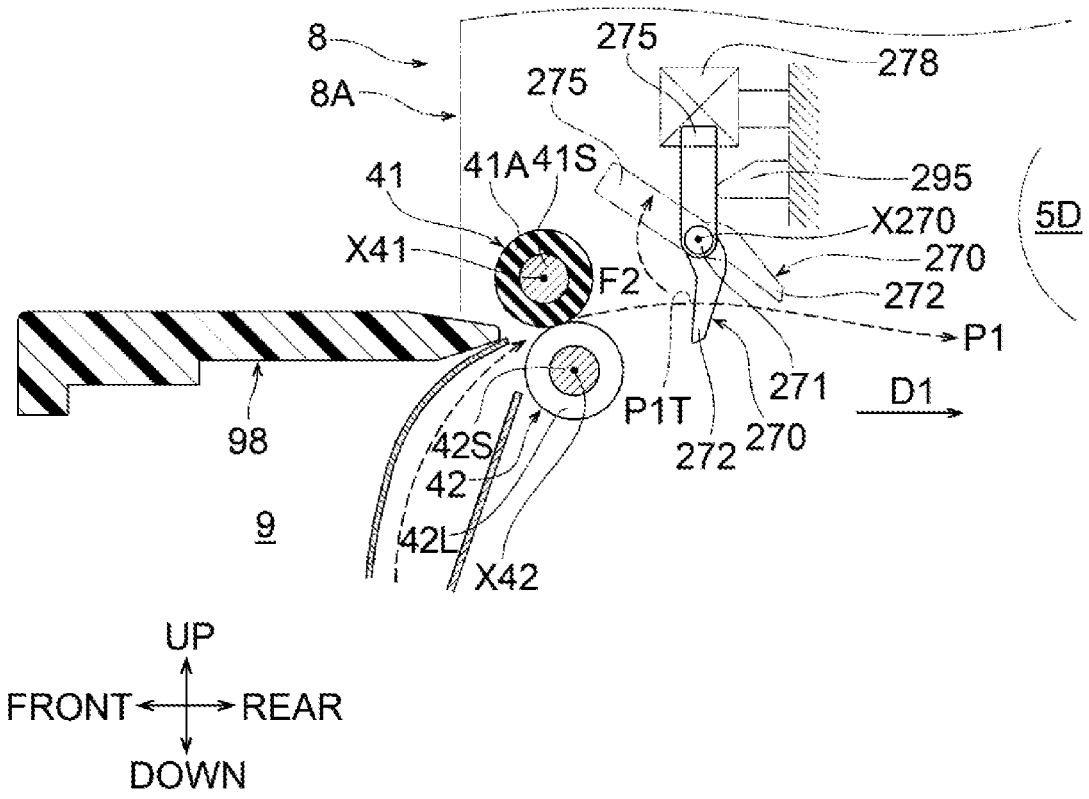
FIG. 11 is a schematic, partial cross sectional view illustrating positional shifts of a cam, a contact portion, and a protrusion when a drawer unit is at an accommodated position according to an image forming apparatus of a second illustrative embodiment of the disclosure.
Figure 12:
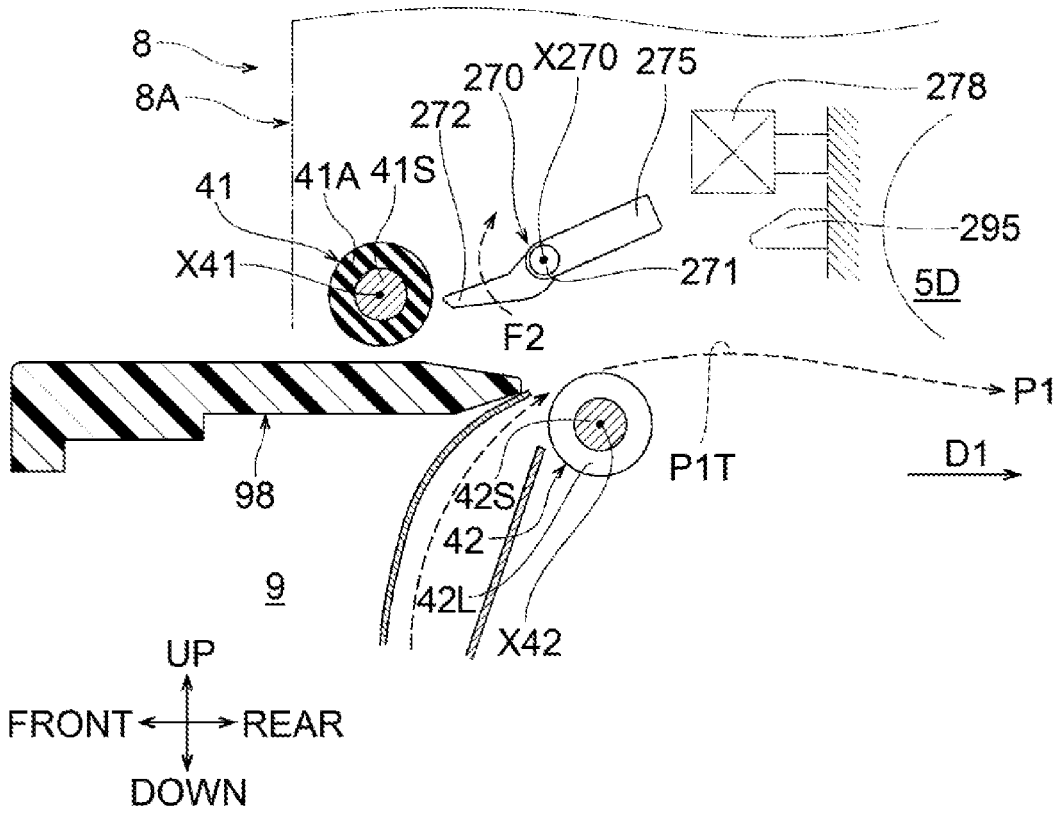
FIG. 12 is a schematic, partial cross sectional view illustrating positional shifts of the cam, the contact portion, and the protrusion when the drawer unit moves between the accommodated position and a shifted position according to the image forming apparatus of the second illustrative embodiment of the disclosure.

An image forming apparatus of a second embodiment uses an actuator 270 and a cam 275 as illustrated in FIGS. 11 and 12, instead of the actuator 70 and the cam 75 used in the image forming apparatus 1 of the first embodiment. This image forming apparatus uses a photo interrupter 278 and a contact portion 295, instead of the photo interrupter 78 and the contact portion 95 used in the first embodiment. Elements other than the above elements in the second embodiment are the same as those in the first embodiment. Thus, elements illustrated and described in the first embodiment are designated by the same reference numerals, and the description thereof will be omitted.

The actuator 270 includes a pivot shaft 271 and a protrusion 272.

The pivot shaft 271 extends along a pivot axis X270 extending in the left-right direction. The pivot shaft 271 is pivotally supported by the drawer 8A.

The protrusion 272 is integrally coupled to a left end of the pivot shaft 271, which is on a side facing into the page of FIG. 11 or 12. The protrusion 272 extends out from the pivot shaft 271 in a radial direction thereof orthogonal to the pivot axis X270. The protrusion 272 is urged upstream in the conveyance direction D1 by an urging force F2 exerted by a helical torsion spring similar to the helical torsion spring 79 of the first embodiment.

The cam 275 is integrally coupled to a right end of the pivot shaft 271, that is on a side facing out of the page of FIG. 11 or 12. The cam 275 extends out from the pivot shaft 271 in a radial direction thereof orthogonal to the pivot axis X270 opposite to the protrusion 272. The cam 275 is movable with the movement of the pivot shaft 271 at a position away from the protrusion 272 in the left-right direction.

The photo interrupter 278 and the contact portion 295 are disposed at the casing 9. As illustrated in FIG. 11, when the drawer unit 8 is at the accommodated position, the photo interrupter 278 and the contact portion 295 are located facing the right side surface of the drawer 8A. The contact portion 295 protrudes frontward in contact with the cam 275.

In this state, the protrusion 272 is maintained at the standby position where the protrusion 272 extends downward and cross the conveyance path P1. In this state, the upper end of the cam 275 blocks the light path of the photo interrupter 278.

When a sheet SH conveyed along the conveyance path P1 contacts the protrusion 272, the sheet SH presses the protrusion 272 downstream in the conveyance direction D1 and then the protrusion 72 pivots to a detection position indicated by two-dot chain lines in FIG. 11. The protrusion 272 at the detection position allows the passing of the sheet SH conveyed along the conveyance path P1. As indicated by the two-dot chain lines in FIG. 11, as the protrusion 272 pivots to the detection position, the upper end of the cam 275 moves away from the photo interrupter 278 frontward and the light path of the photo interrupter 278 is opened.

When the drawer unit 8 moves upstream in the conveyance direction D1 from the accommodated position illustrated in FIG. 11 toward the shifted position illustrated in FIG. 12, the cam 275, which moves frontward with the drawer 8A, moves away from the contact portion 295. The protrusion 272 thus pivots upstream in the conveyance direction D1 by the urging force F2 from the standby position in a manner away from the second frame 98 and the second roller 42, and then is maintained at the retracted position. This structure may prevent the second frame 98 and the second roller 42 in the drawer unit 9 from interfering or colliding with the protrusion 272 that moves frontward with the drawer 8A.

In contrast, when the drawer unit 8 moves downstream in the conveyance direction D1 from the shifted position toward the accommodated position illustrated in FIG. 11, the cam 275, which moves rearward with the drawer 8A, contacts the contact portion 95. The protrusion 272 thus pivots downstream in the conveyance direction D1 from the retracted position after passing over the second frame 98 and the second roller 42, and then is maintained at the standby position. This structure may prevent the second frame 98 and the second roller 42 in the drawer unit 9 from interfering or colliding with the protrusion 272 that moves rearward with the drawer 8A.

The image forming apparatus of the second embodiment thus may prevent an occurrence of damage to the protrusion 272 of the actuator 270 during movement of the drawer unit 8 between the accommodated position and the shifted position, as with the image forming apparatus of the first embodiment.

The above embodiments are merely an example. Various changes, arrangements and modifications may be applied therein without departing from the spirit and scope described herein.

In the first and second embodiments, the cam 75, 275 is integrally formed with the pivot shaft 71, 271 but is not limited to this structure. For example, the cam may be an individual element discretely separated from the pivot shaft or may be a link that moves with the movement of the pivot shaft.

In the first and second embodiments, the drawer unit 8 is an example of an image forming unit but is not limited to this structure. For example, the image forming unit may be a transfer belt unit or a fixing unit which is movably disposed in the casing.

What is claimed is:

1. An image forming apparatus comprising:

a casing;

an image forming unit for forming an image on a sheet, movable between an accommodated position at which the image forming unit is accommodated in the casing and faces a conveyance path along which a sheet is conveyed in a conveyance direction, and a shifted position which is located upstream from the accommodated position in the conveyance direction and at which the image forming unit is shifted toward an exterior of the casing;

an actuator pivotally supported by one of the casing and the image forming unit, the actuator including a pivot shaft and a protrusion, the pivot shaft extending in a direction orthogonal to the conveyance direction, the protrusion protruding from the pivot shaft, the protrusion at a standby position crossing the conveyance path and being contactable with a sheet conveyed along the conveyance path;

an urging member exerting an urging force to urge the protrusion upstream in the conveyance direction;

a cam movable with movement of the pivot shaft at a position away from the protrusion in a direction in which the pivot shaft extends; and a contact portion located at the other of the casing and the image forming unit, wherein the contact portion and the cam are configured to:

when the image forming unit is at the accommodated position, contact each other and maintain the protrusion at the standby position against the urging force of the urging member; and as the image forming unit moves from the accommodated position to the shifted position, move away from each other such that the protrusion pivots from the standby position, by the urging force of the urging member, upstream in the conveyance direction to a retracted position at which the protrusion is retracted from the conveyance path.

2. An The image forming apparatus according to claim 1, wherein the image forming unit includes a photosensitive member, wherein, when the image forming unit is at the accommodated position, the actuator is located upstream from the photosensitive member in the conveyance direction, and the cam and the contact portion are located closer to an exterior of the casing than the photosensitive member in the direction in which the pivot shaft extends.

3. The image forming apparatus according to claim 2, wherein, when the image forming unit is at the accommodated position, the cam and the contact portion are located upstream from the photosensitive member in the conveyance direction.

4. The image forming apparatus according to claim 3, wherein the cam is coupled to the pivot shaft rotatably integrally therewith.

5. The image forming apparatus according to claim 4, further comprising a first roller and a second roller facing each other to pinch and convey the sheet therebetween toward the photosensitive member, wherein the first roller and the contact portion are disposed at the image forming unit, wherein the second roller, the actuator, the urging member, and the cam are disposed at the casing, and wherein, when the first roller moves with the image forming unit moving from the accommodated position toward the shifted position, the protrusion enters a first space, which is left after the first roller moves.

6. The image forming apparatus according to claim 5, wherein the protrusion at the retracted position is shaped such that the protrusion extends from the pivot shaft to the conveyance path, and then bends upstream in the conveyance direction to extend along the conveyance path.

7. The image forming apparatus according to claim 6, wherein the second roller includes a rotation shaft, a first cylindrical portion extending in an axial direction of the rotation shaft, and a second cylindrical portion extending in the axial direction of the rotation shaft and being spaced by a particular distance from the first cylindrical portion, and wherein, when the protrusion pivots to the retracted position, the protrusion enters a gap between the first cylindrical portion and the second cylindrical portion.

8. The image forming apparatus according to claim 7, wherein the protrusion has a recessed portion, and wherein, when the protrusion is at the retracted position, the recessed portion is recessed to stay out of the rotation shaft of the second roller and an upper portion of the protrusion downwardly faces the rotation shaft of the second roller.

9. The image forming apparatus according to claim 8, wherein the casing has a frame disposed upstream from the second roller in the conveyance direction, and wherein, when a distal end of the protrusion, which receives the urging force, contacts and stops at the frame, the protrusion is maintained at the retracted position.

10. The image forming apparatus according to claim 9, wherein the cam has a restrictive surface, which faces the rotation shaft of the second roller when the distal end of the protrusion contacts and stops at the frame.

11. An The image forming apparatus according to claim 5, wherein the contact portion has:

a first surface to face the protrusion from above and maintain the protrusion at the standby position when the image forming unit is at the accommodated position; and a second surface to contact the cam ahead of the first surface when the image forming unit moves from the shifted position toward the accommodated position, and wherein the second surface of the contact portion is an inclined surface connected to the first surface and inclined upward and downstream in the conveyance direction.

12. An The image forming apparatus according to claim 11, wherein the first surface comprises a cushioning member, and wherein, when the image forming unit is at the accommodated position, the cushioning member contacts the cam from above.

13. The image forming apparatus according to claim 11, wherein, while the image forming unit moves from the shifted position to the accommodated position, the second surface of the contact portion contacts the cam, the protrusion moves downstream in the conveyance direction ahead of the first roller returning to the first space, the first surface of the contact portion contacts the cam, and the protrusion is maintained at the standby position away from the first roller and the second roller downstream in the conveyance direction by a particular distance.

14. An The image forming apparatus according to claim 1, wherein the actuator and the cam are supported by the casing, and the contact portion is located at the image forming unit, and wherein the contact portion is configured to:

when the image forming unit is at the accommodated position, contact the cam and maintain the protrusion of the actuator at the standby position against the urging force of the urging member; and as the image forming unit moves from the accommodated position to the shifted position, move away from the cam such that the protrusion pivots from the standby position, by the urging force of the urging member, upstream in the conveyance direction to a retracted position at which the protrusion is retracted from the conveyance path.

15. The image forming apparatus according to claim 1, wherein the actuator and the cam are supported by the image forming unit, and the contact portion is located at the casing, and wherein the cam is configured to:

when the image forming unit is at the accommodated position, contact the contact portion located at the casing and maintain the protrusion of the actuator supported by the image forming unit; and as the image forming unit moves from the accommodated position to the shifted position, move away from the contact portion such that the protrusion pivots from the standby position, by the urging force of the urging member, upstream in the conveyance direction to a retracted position at which the protrusion is retracted from the conveyance path.

* * * * *